US007873294B2

(12) United States Patent
Nobe et al.

(10) Patent No.: US 7,873,294 B2
(45) Date of Patent: Jan. 18, 2011

(54) IMAGE FORMING APPARATUS WITH INCREASED NOISE RESISTANCE

(75) Inventors: Hiroshi Nobe, Nagoya (JP); Hiroyuki Okuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 889 days.

(21) Appl. No.: 11/692,494

(22) Filed: Mar. 28, 2007

(65) Prior Publication Data

US 2007/0230988 A1 Oct. 4, 2007

(30) Foreign Application Priority Data

Mar. 29, 2006 (JP) ..... 2006-090953

(51) Int. Cl.
*G03G 15/00* (2006.01)

(52) U.S. Cl. ..... 399/88; 399/90

(58) Field of Classification Search ..... 399/37, 399/88, 90

See application file for complete search history.

(56) References Cited

U.S. PATENT DOCUMENTS

2003/0117477 A1* 6/2003 Yamanaka ..... 347/129

FOREIGN PATENT DOCUMENTS

| | | |
|---|---|---|
| JP | 5323698 | 12/1993 |
| JP | 6230617 | 8/1994 |
| JP | 7134534 | 5/1995 |
| JP | 7299928 | 11/1995 |
| JP | 2001134031 | 5/2001 |
| JP | 2001156964 | 6/2001 |
| JP | 2001235919 | 8/2001 |
| JP | 2001238045 A * | 8/2001 |

* cited by examiner

*Primary Examiner*—David M Gray
*Assistant Examiner*—Barnabas T Fekete
(74) *Attorney, Agent, or Firm*—Banner & Witcoff, Ltd.

(57) ABSTRACT

An image forming apparatus includes a placement tray, an image forming unit, a drive unit, a control board, a power supply substrate, a high-voltage board, and low-voltage power supply harnesses. The placement tray holds a recording sheet thereon. The image forming unit forms an image on the recording sheet. The drive unit supplies driving force to the image forming unit. The control board controls the drive unit. The power supply substrate supplies electric power to the control board. The high-voltage board is disposed in one side of the placement tray. In the high-voltage board, voltage is generated higher than voltage in the power supply substrate. The low-voltage power supply harnesses are disposed in another side of the placement tray so as to supply electric power from the power supply substrate to the control board.

11 Claims, 8 Drawing Sheets

IMAGE FORMING APPARATUS WITH INCREASED NOISE RESISTANCE

CROSS-REFERENCE TO RELATED APPLICATIONS

This application claims the benefit of Japanese Patent Application No. 2006-090953 filed on Mar. 29, 2006 in the Japanese Patent Office, the disclosure of which is incorporated herein by reference.

BACKGROUND

The present invention relates to an image forming apparatus. The present invention is especially effective for image forming apparatus for electrophotography, such as a laser printer, copier, and the like.

Image forming apparatus generally includes a control board having a control circuit, and a power substrate which supplies electric power to the control board and others.

For example, in some type of image forming apparatus, a control board and a high-voltage board are disposed next to each other above a placement tray. A power supply substrate is disposed below the control board and the high-voltage board.

Moreover, the control board and the power supply substrate are connected by a cable so as to supply electric power from the power supply substrate to the control board.

SUMMARY

However, in the above-described configuration, if the cable is disposed adjacent to the high-voltage board having a high-voltage circuit, there is a possibility that the cable is influenced by noise from the high-voltage board.

If the noise influence from the high-voltage board remains in control signals generated by the control circuit, the quality of an image, formed on a recording medium, is likely to be reduced.

One aspect of the present invention provides a technique to inhibit a cable, which supplies electric power from a power supply substrate to a control board, from being influenced by such noise.

In one aspect of the present invention, an image forming apparatus may include a placement tray, an image forming unit, a drive unit, a control board, a power supply substrate, a high-voltage board, and low-voltage power supply harnesses. The placement tray holds a recording sheet thereon. The image forming unit forms an image on the recording sheet. The drive unit supplies driving force to the image forming unit. The control board controls the drive unit. The power supply substrate supplies electric power to the control board. The high-voltage board is disposed in one side of the placement tray. In the high-voltage board, voltage is generated higher than voltage in the power supply substrate. The low-voltage power supply harnesses are disposed in another side of the placement tray so as to supply electric power from the power supply substrate to the control board.

Therefore, in this aspect of the present invention, the placement tray interposes between the low-voltage power supply harnesses and the high-voltage board so as to separate the low-voltage power supply harnesses and the high-voltage board.

As a result, the influence of high voltage, generated in the high-voltage board, to the low-voltage power supply harnesses may be reduced, as compared to a case wherein the low-voltage power supply harnesses and the high-voltage board are both disposed in one side of the placement tray.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

The following describes a laser printer to which the image forming apparatus according to the present invention is adopted.

Figure 1:
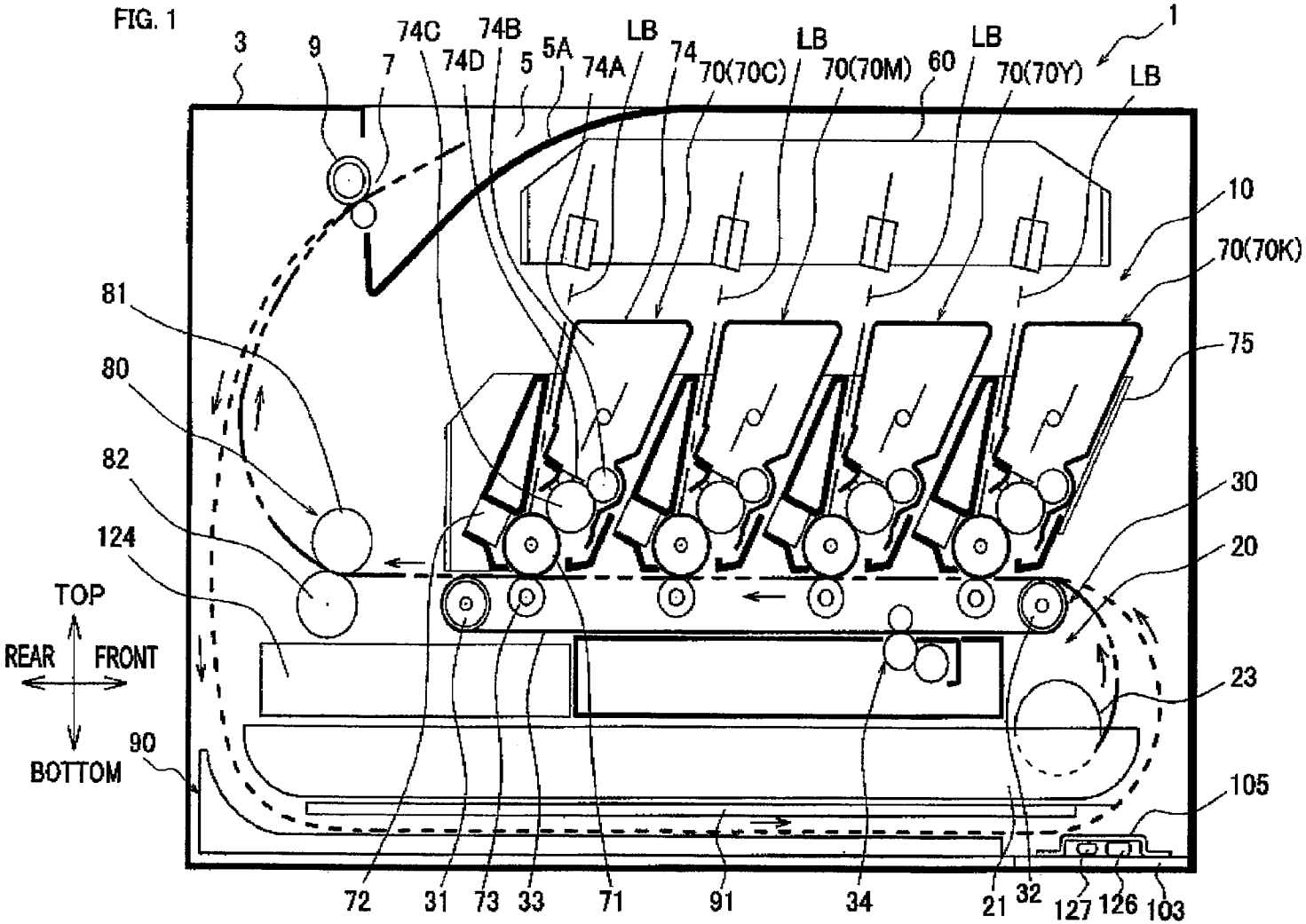
FIG. 1 is a sectional side view showing a schematic structure of a laser printer according to an embodiment of the present invention.

It is to be noted that a paper feed tray 21 is diagrammatically shown in FIG. 1, and that a portion thereof projecting outside of the housing 3 is not shown in the figure. It is also to be noted that a drive unit 110 (see FIG. 7) is not shown in FIG. 4.

1. Overall Structure of Laser Printer

Referring to FIG. 1, a laser printer 1 according to the present embodiment includes a housing 3, formed approximately in a box shape (a cubical shape). In the top surface side of the housing 3, a paper discharge tray 5 is disposed for placing paper, OHP sheets, and so on (to be simply referred to as paper) discharged from the housing 3 after printing.

The paper discharge tray 5 is constituted with a tilted surface 5A, declined from the top surface of the housing 3 toward the rear side. In the rear end side of the tilted surface 5A, a discharge unit 7 is provided. Paper, on which printing has been performed, is discharged to the discharge unit 7.

Inside of the housing 3, a frame 100 (see FIG. 2), made of metal, resin, or the like, is disposed. Process cartridges 70 and a fixation unit 80, to be described later, are attachably/detachably installed within the frame 100 disposed inside of the housing 3.

2. Internal Structure of Laser Printer

As shown in FIG. 1, the laser printer 1 includes an image forming unit 10 and a feeder unit 20. The image forming unit 10 forms an image on paper. The feeder unit 20 supplies paper to the image forming unit 10.

The laser printer 1 further includes a conveyance mechanism 30 and a duplex printing unit 90. The conveyance mechanism 30 conveys paper to four process cartridges 70K, 70Y, 70M, and 70C constituting the image forming unit 10. The duplex printing unit 90 reconveys paper, on which printing (image formation) has been performed, to the image forming unit 10.

2.1 Feeder Unit and Conveyance Mechanism

As shown in FIG. 1, the feeder unit 20 includes a paper feed tray 21, a paper feed roller 23. The paper feed tray 21 is stored in the bottom side of the housing 3. The paper feed roller 23 is disposed above the front portion of the paper feed tray 21, and feeds (conveys) paper, placed on the paper feed tray 21, to the image forming unit 10.

Figure 3:
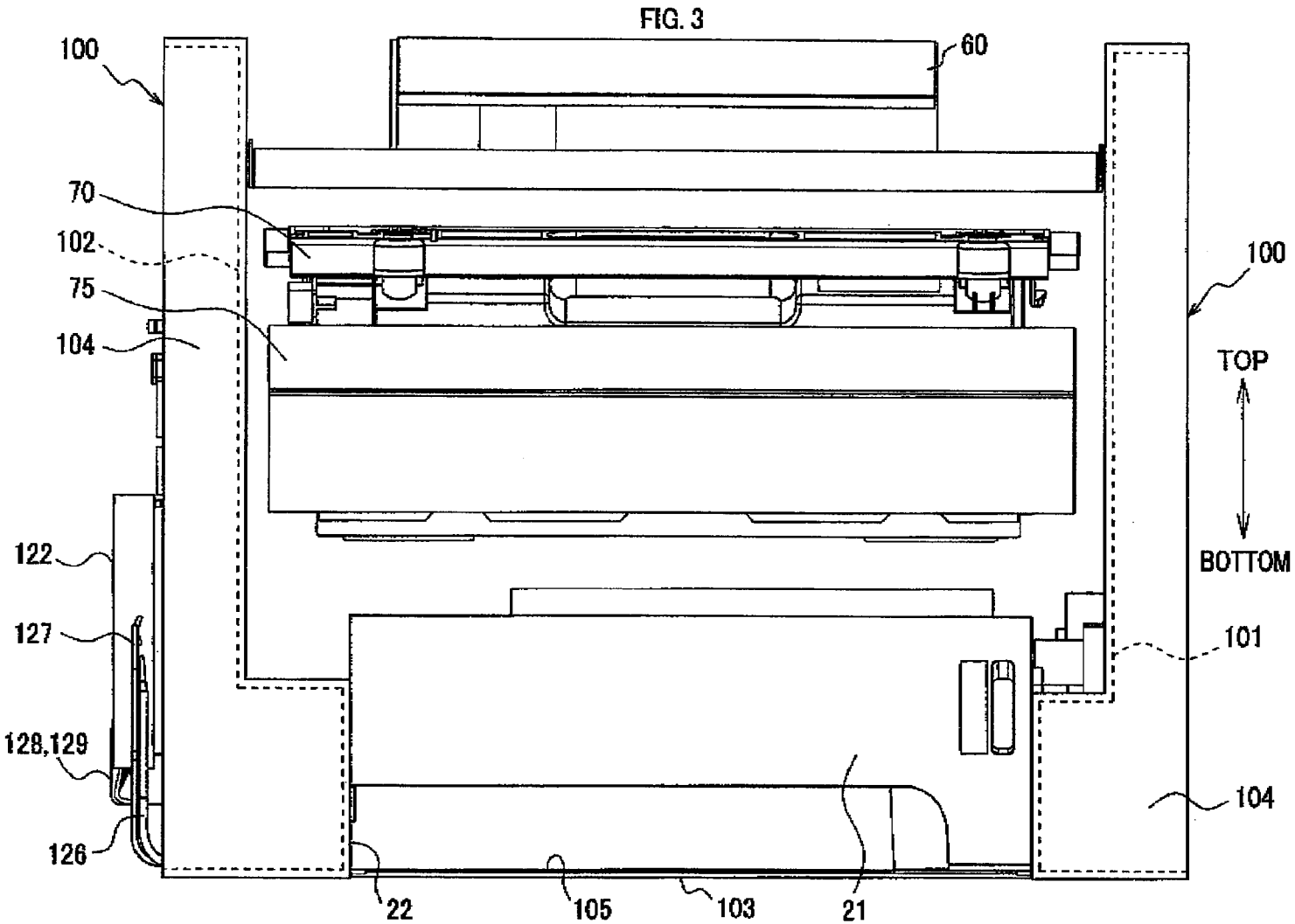
FIG. 3 is a view on arrow A in FIG. 2 showing the schematic structure of the laser printer according to the embodiment.

The paper feed tray 21 is installed in the body of the laser printer 1 in an attachable/detachable manner. An installation opening 22 (see FIG. 3) is provided in the lower portion of the front surface of the body of the laser printer 1 so as to install the paper feed tray 21 therefrom.

The conveyance mechanism 30 includes a driving roller 31, a driven roller 32, and a conveyance belt 33. The driving roller 31 is rotated corresponding to the operation of the image forming unit 10. The driven roller 32 rotatably disposed in a position away from the driving roller 31. The conveyance belt 33 runs between the driving roller 31 and the driven roller 32.

When the conveyance belt 33 is rotated while carrying paper thereon, the paper, fed from the paper feed tray 21, is conveyed sequentially to the four process cartridges 70K, 70Y, 70M, and 70C.

The conveyance mechanism 30 further includes a belt cleaner 34. The belt cleaner 34 removes toner adhered to the conveyance belt 33.

2.2 Image Forming Unit

The image forming unit 10 includes a scanner unit 60, the process cartridges 70, and the fixation unit 80.

The image forming unit 10 according to the present embodiment is capable of color printing, and is so-called a tandem type direct printing unit. In the present embodiment, from the upstream side of the paper conveyance direction, the four process cartridges 70K, 70Y, 70M, and 70C, respectively corresponding to the four colors of toner (developer); black, yellow, magenta, and cyan, are aligned in series along the paper conveyance direction.

The four process cartridges 70K, 70Y, 70M, and 70C are different from one another only in the way that the colors of toner contained therein are different, but otherwise configured the same. Therefore, the four process cartridges 70K, 70Y, 70M, and 70C are generically referred to as the process cartridges 70.

2.2.1. Scanner Unit

The scanner unit 60 is disposed in the upper portion inside of the housing 3, and forms latent images on the surfaces of photoreceptor drums 71 respectively provided to the four process cartridges 70K, 70Y, 70M, and 70C. Specifically, the scanner unit 60 includes a laser beam source, a polygon mirror, a fθ lens, and reflection mirrors (not shown in the figure).

A laser beam LB, emitted from the laser beam source based on image data, is deflected by the polygon mirror, and passes through the fθ lens. The path of the beam is returned by the reflection mirror, and then further turned downward by the reflection mirror. The laser beam LB is emitted on the surfaces of the photoreceptor drums 71, and latent images are formed.

2.2.2. Process Cartridges

As described above, the four process cartridges 70K, 70Y, 70M, and 70C are different from one another only in the way that the colors of toner contained therein are different, but otherwise configured the same. The following takes the process cartridge 70C as an example and describes the structure thereof.

The process cartridge 70 is attachably/detachably disposed below the scanner unit 60 in the housing 3. The process cartridge 70 includes a photoreceptor drum 71, a charger 72, and a process casing 75. The process casing 75 stores a development cartridge 74 and so on.

A transfer roller 73 is disposed in the opposite side to the photoreceptor drum 71 across the conveyance belt 33, and rotatably supported by the frame 100.

The photoreceptor drum 71 holds an image to be transferred to paper. The charger 72 electrically charges the surface of the photoreceptor drum 71.

In the present embodiment, a scorotron charger is used as the charger 72. This type of charger positively charges the surface of the photoreceptor drum 71 in an approximately uniform manner by conducting corona discharge from a charging wire made of tungsten and the like.

The transfer roller 73 is disposed so as to face the photoreceptor drum 71, and rotated corresponding to the rotation of the photoreceptor drum 71. When paper passes in vicinity of the photoreceptor drum 71, the transfer roller 73 applies electric charge (negative electric charge in the present embodiment), which is opposite to the electric charge charged on the photoreceptor drum 71, to the paper from the opposite side of the printing surface. The transfer roller 73 thereby transfers toner, adhered to the surface of the photoreceptor drum 71, on to the printing surface of the paper.

The development cartridge 74 includes a toner storage container 74A, a toner supply roller 74B, a development roller 74C, and a layer thickness restriction blade 74D. The toner storage container 74A stores toner. The toner supply roller 74B supplies toner to the photoreceptor drum 71.

The toner, stored in the toner storage container 74A, is supplied toward the development roller 74C by the rotation of the toner supply roller 74B. The toner supplied toward the development roller 74C is held on the surface of the development roller 74C, and adjusted by the layer thickness restriction blade 74D so that the thickness of the toner held on the surface of the development roller 74C becomes a constant (uniform) predetermined thickness. Then, the toner is supplied to the surface of the photoreceptor drum 71 exposed to laser beam LB by the scanner unit 60.

2.2.3. Fixation Unit

The fixation unit 80 is disposed in the downstream side of the photoreceptor drum 71 in the paper conveyance direction. The fixation unit 80 fixes toner, transferred on to paper, by heating and melting the toner. The fixation unit 80 is attached to the frame 100 in an attachable/detachable manner.

Specifically, the fixation unit 80 includes a heat roller 81 and a pressure roller 82. The heat roller 81 is disposed so as to face the printing surface of paper, and applies conveyance force to paper while heating toner. The pressure roller 82 is disposed on the other side of paper opposite to the heat roller 81, and presses paper toward the heating roller 81.

2.2.4. General Description of Image Forming Operation

As the photoreceptor drum 71 is rotated, the surface thereof is positively charged in a uniform manner by the charger 72, and exposed to high-speed scanning of laser beam LB emitted from the scanner unit 60. Consequently, on the surface of the photoreceptor drum 71, a latent image based on image date is formed corresponding to an image to be formed on paper.

Subsequently, as the development roller 74C is rotated, toner, held on the development roller 74C and been positively charged, is supplied to the latent image formed on the surface of the photoreceptor drum 71 when the toner faces and contacts the photoreceptor drum 71. That is, the toner is supplied to an exposed portion of the surface of the photoreceptor drum 71, which is positively charged in a uniform manner. In the exposed portion, electric potential has become low due to exposure to the laser beam LB. The latent image on the photoreceptor drum 71 thereby becomes visualized, and a toner image by reversal development is held on the surface of the photoreceptor drum 71.

Subsequently, the toner image, held on the surface of the photoreceptor drum 71, is transferred on to paper by transfer bias applied to the transfer roller 73. The paper, to which the toner image is transferred, is conveyed to the fixation unit 80, and heated. The toner, transferred as the toner image, is fixed on the paper, and then, image formation is completed.

2.3. Duplex Printing Unit

The duplex printing unit 90 reconveys paper, on which printing (image formation) has been performed, to the image forming unit 10, while the surface of the paper is reversed, so that images can be printed on both sides of the paper. The duplex printing unit 90 is disposed below the paper feed tray 21.

The duplex printing unit 90 includes a guide member 91 which guides paper so as to inhibit paper, conveyed to the duplex printing unit 90 in duplex printing, from hitting the bottom portion of the paper feed tray 21.

In single-side printing, paper fed from the paper feed tray 21 to the image forming unit 10 goes through the image forming operation wherein an image is formed on one printing surface. Then, conveyance of the paper is directed upward due to a discharge chute (not shown). The paper is discharged from the discharge unit 7 to the paper discharge tray 5 (see the dashed double-dotted line).

In the duplex printing, paper fed from the paper feed tray 21 to the image forming unit 10 goes through the image forming operation wherein an image is formed on one printing surface, and is conveyed toward the discharge unit 7. When the trailing end of the paper in the conveyance direction reaches the discharge roller 9, disposed in vicinity of the discharge unit 7, the rotation of the discharge roller 9 is reversed. The paper, wherein an image is formed on one of the printing surfaces, is conveyed toward the duplex printing unit 90, and then to the image forming unit 10 once again (see the bold dashed line).

2.4. Frame

Figure 2:
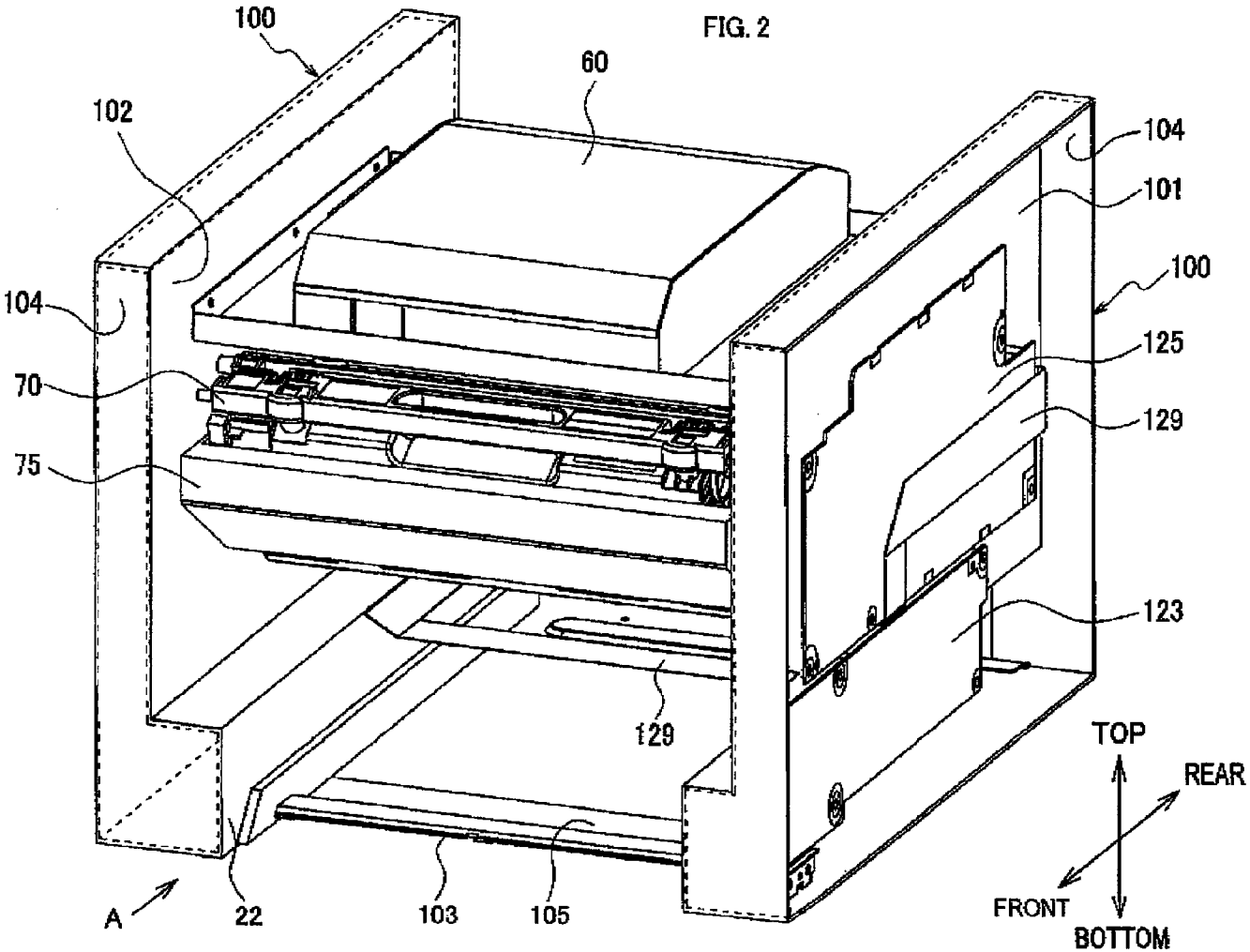
FIG. 2 is a perspective view showing the laser printer wherein a housing and a paper feed tray of the printer are removed therefrom.

As shown in FIG. 2, the frame 100 includes a first side-frame 101, a second side-frame 102, and a bottom frame 103. The first and the second side-frames 101, 102 are disposed so as to face each other in the horizontal direction. The bottom frame 103 is disposed in the bottom portion of the laser printer 1, and connects the bottom portions of the first and the second frames 101, 102.

The frame 100 according to the present embodiment is made of resin, such as PC, ABS, polymer alloy, and the like, having a good mechanical strength.

In the present embodiment, the bottom frame 103 connects the first and the second side-frames 101, 102 in the vicinity of the installation opening 22 in the attachment/detachment direction of the paper feed tray 21 (in the front-to-rear direction of the laser printer 1 in the present embodiment).

The first and the second side-frames 101, 102 are formed approximately in a plate shape so as to extend in the vertical direction (in the up-and-down direction). The outer peripheries of the first and the second side-frames 101, 102 are respectively provided with projected walls (ribs) 104 so as to improve the mechanical strength of the frames 101, 102.

Figure 7:
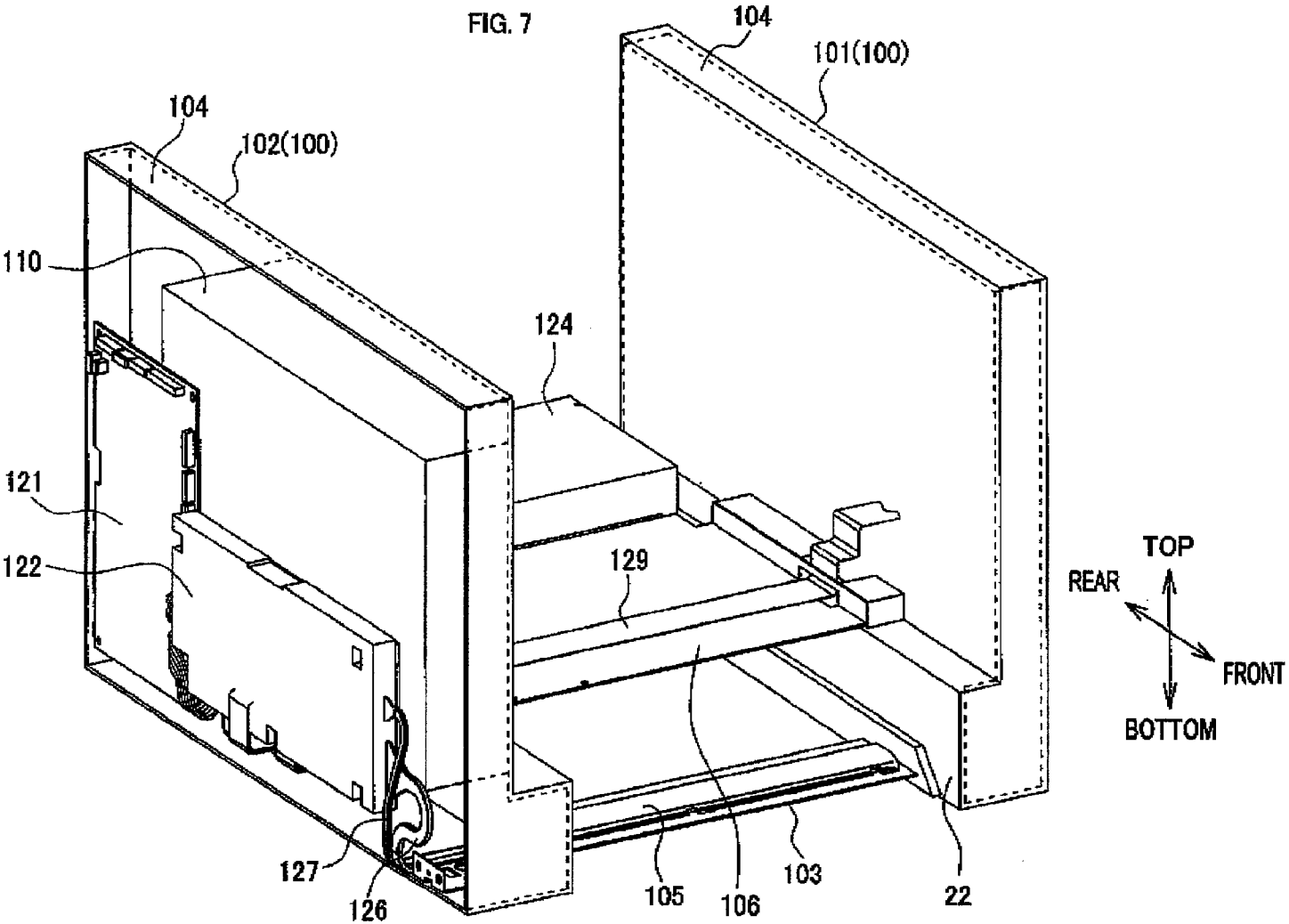
FIG. 7 is a left side perspective view showing a positional relation between the frame and a drive unit control board of the printer according to the embodiment.

As shown in FIG. 2, a low-voltage power supply circuit substrate 123 and a high-voltage power source board 125 for the charger 72, which will be described later, are attached to the first side-frame 101. To the second side-frame 102, a main control board 121 and a drive unit control board 122, which will be described later, are attached as shown in FIG. 7. The surfaces of the boards 121, 122, 124, and 125 are all disposed approximately in parallel to the side-frames 101, 102 so as to extend in the vertical direction.

Between the second side-frame 102 and the drive unit control board 122, a drive unit 110 is disposed. The drive unit 110 supplies rotational driving force to the drive roller 31 of the conveyance mechanism 30, the photoreceptor drums 71 of the image formation unit 10, and so on. The drive unit 110 includes an electric motor, which generates the rotational driving force, and a teeth mechanism having a plurality of teeth which transmits the rotational driving force generated by the electric motor to the driving roller 31, the photoreceptor drums 71, and so on.

Figure 8:
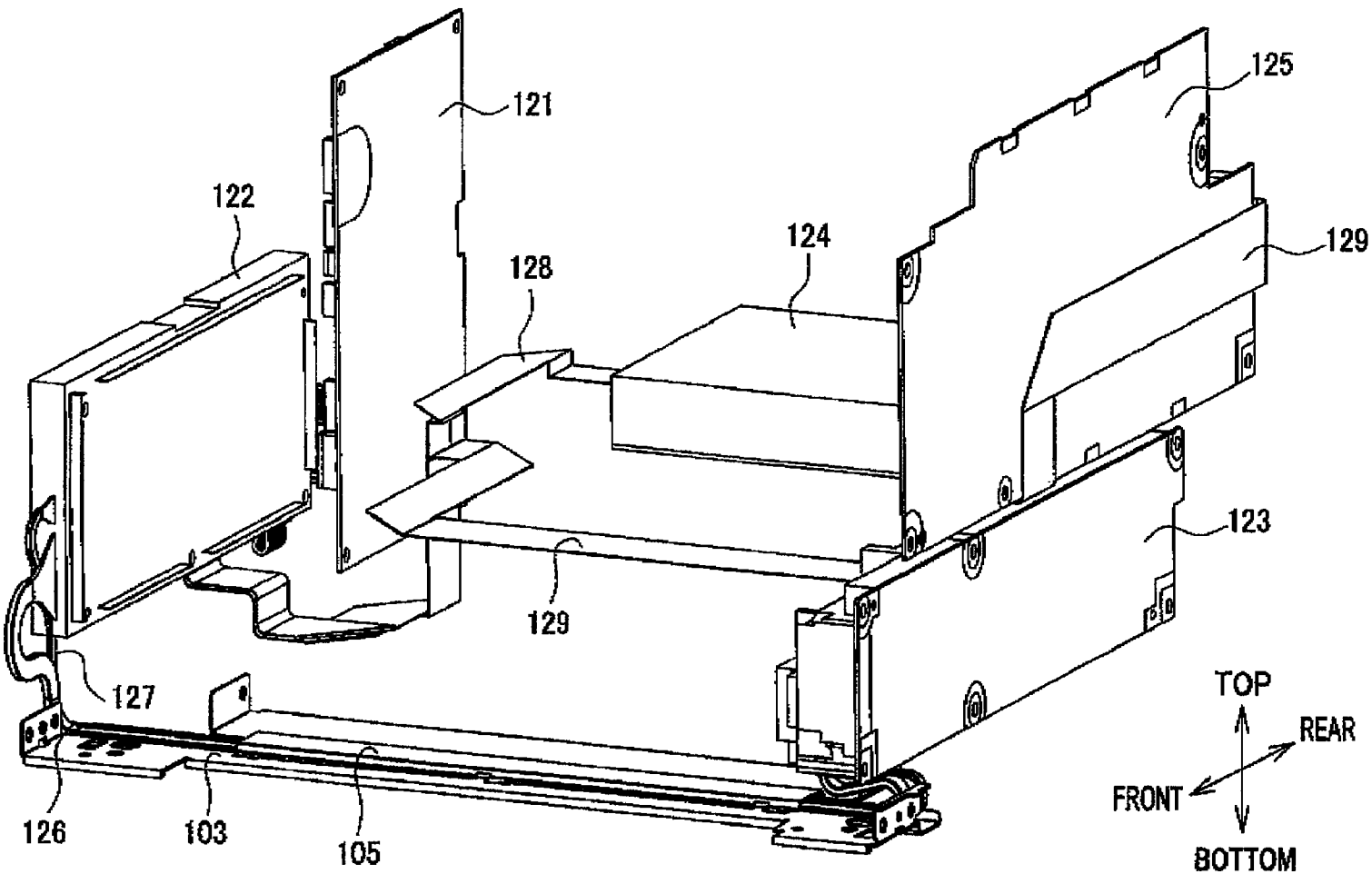
FIG. 8 is a perspective view showing a connection of the respective boards of the printer according to the embodiment.

As also shown in FIG. 8, the main control board 121 controls respective boards, to be described later, upon receiving a print command from a computer (not shown) connected to the laser printer 1. The drive unit control board 122 controls the drive unit 110 based on a command signal from the main control board 121.

The low-voltage power supply circuit substrate 123 supplies electric power to the drive unit control board 122. The low-voltage power supply circuit substrate 123 provides the drive unit control board 122 with two types of electric power: electric power for driving the drive unit control board 122 (8V power supply in the present embodiment) and electric power for driving the drive unit 110 (24V in the present embodiment).

A high-voltage power supply board 124 for the transfer roller 73 is a high-voltage board which generates high voltage (equal to or higher than 1000V in the present embodiment) to be applied to the transfer roller 73 for transfer bias. The high-voltage power supply board 124 is disposed above the paper feed tray 21, and supported by the top surface of a support frame 106 (see FIG. 6) disposed between the first and the second side-frame 101, 102.

The high-voltage power supply board 125 for the charger 72 generates high-voltage (equal to or higher than 1000V in the present embodiment) for the charger 72. The high-voltage power supply board 125 is supported by the first side-frame 101.

In the present embodiment, a command signal (control signal) from the main control board 121 is sent to both of the high-voltage power supply boards 124, 125 via the drive unit control board 122. Therefore, both of the high-voltage power supply boards 124, 125 are controlled and operated electrically in conjunction with the drive unit control board 122.

Electric power is supplied from the low-voltage power supply circuit substrate 123 to the high-voltage power supply board 125 and to the drive unit control board 122. The electric power is further supplied from the drive unit control board 122 to the high-voltage power supply board 124 and to the main control board 121.

Figure 4:
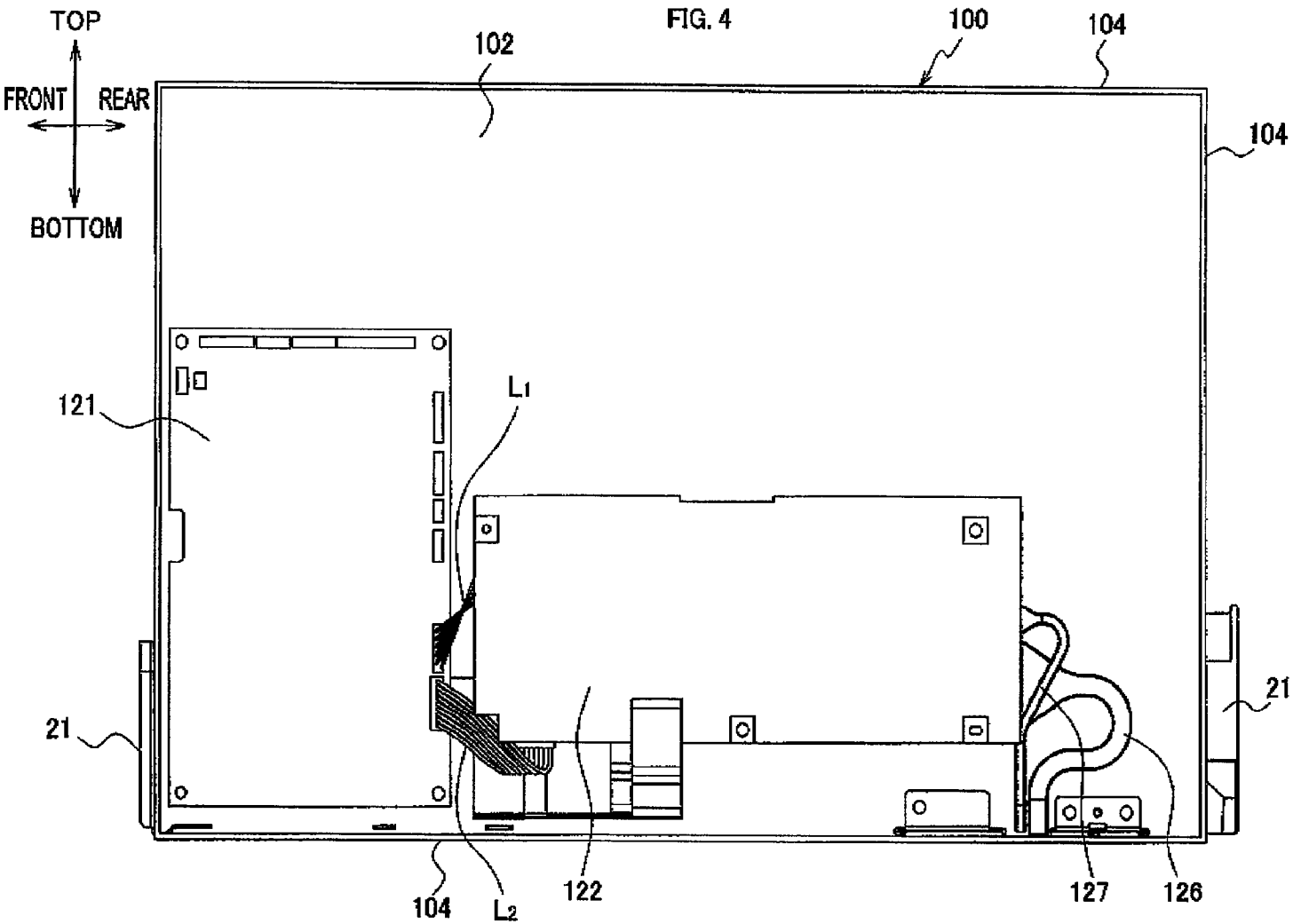
FIG. 4 is a side view showing the left side of the printer shown in FIG. 3.

The drive unit control board 122 and the main control board 121 are connected by a power line L2 (see FIG. 4). The drive unit control board 122 supplies the electric power to the main control board 121 through the power line L2.

The drive unit control board 122 and the main control board 121 are also connected by a signal line L1 (see FIG. 4). The main control board 121 outputs a control signal for controlling the drive unit control board 122 to the drive unit control board 122 through the signal line L1.

Figure 5:
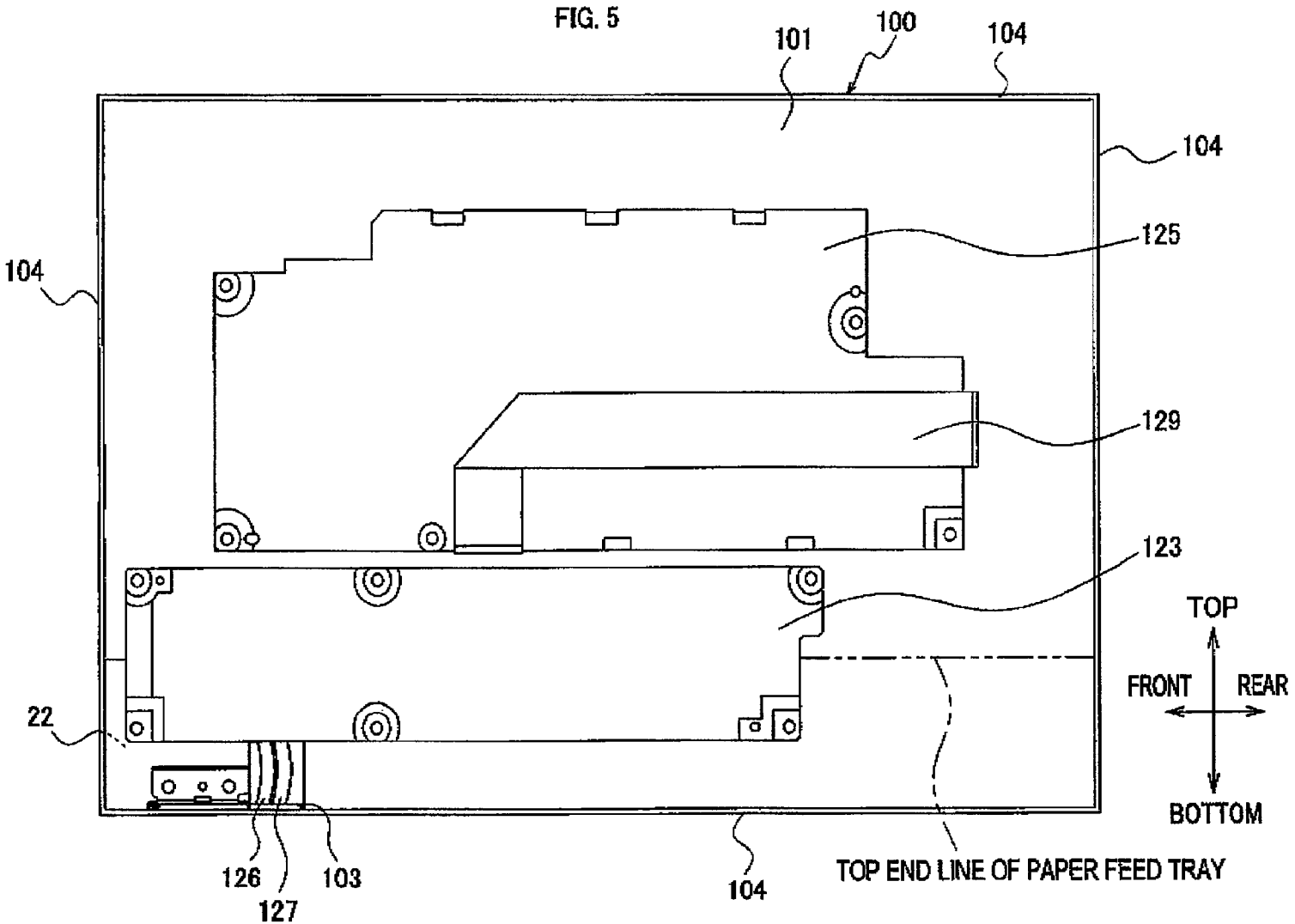
FIG. 5 is a side view showing the right side of the printer shown in FIG. 3 wherein the paper feed tray is removed.
Figure 6:
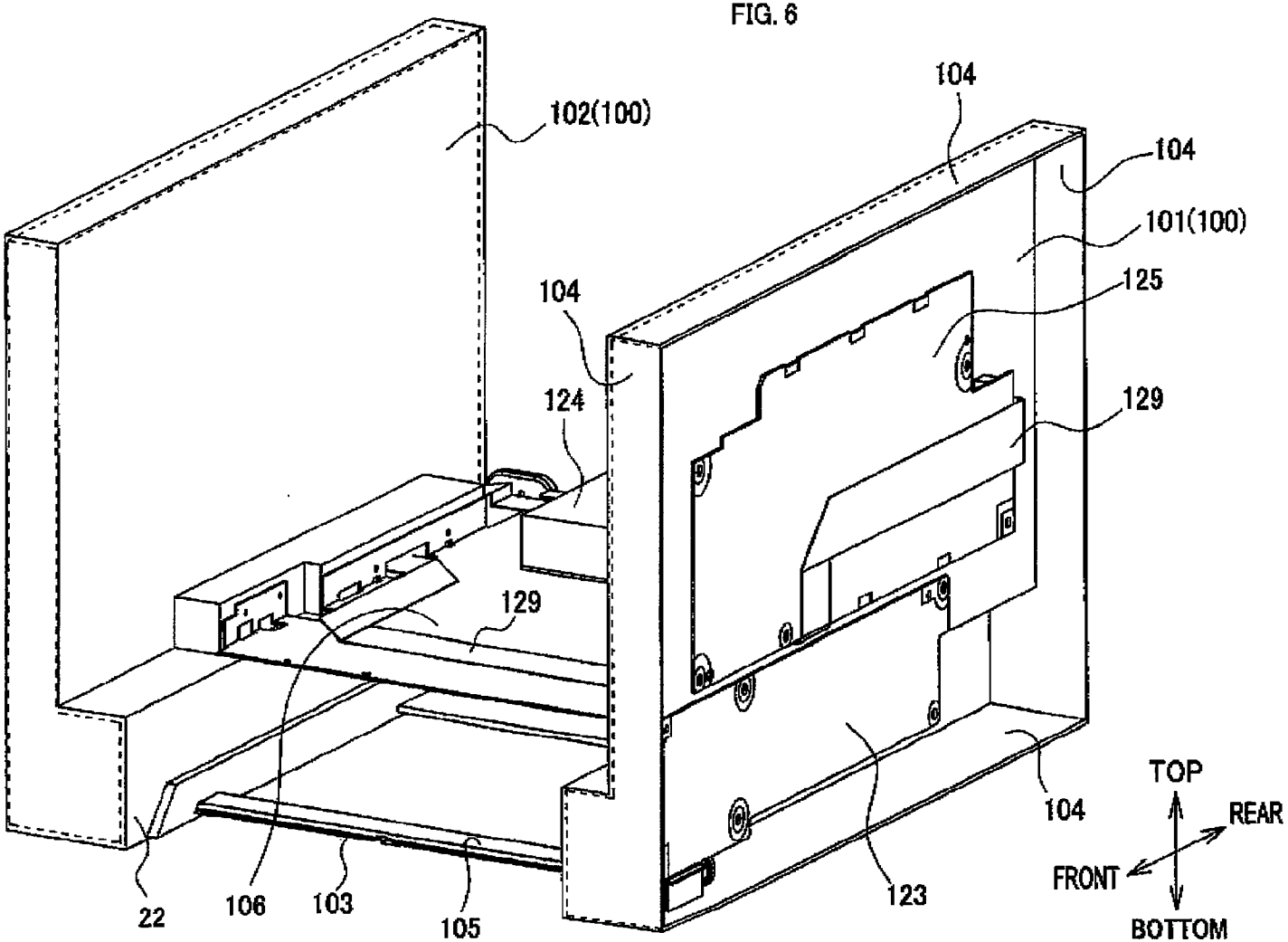
FIG. 6 is a right side perspective view showing a positional relation between a frame and a high-voltage power supply board for a charger of the printer according to the embodiment.

As shown in FIGS. 5 and 6, the high-voltage power supply boards 124, 125 are disposed above the paper feed tray 21. Low-voltage power supply harnesses 126, 127, which supply electric power from the low-voltage power supply circuit substrate 123 to the drive unit control board 122, are disposed below the paper feed tray 21.

The low-voltage power supply harness 126 is used so as to supply electric power for driving the drive unit control board 122. The low-voltage power supply harness 127 is used so as to supply electric power for driving the driving unit 110.

As shown in FIG. 8, a harness 128 connects the high-voltage power supply board 124 and the drive unit control board 122. A harness 129 connects the high-voltage power supply board 125 and the drive unit control board 122.

The drive unit control board 122 outputs a control signal for controlling the high-voltage power supply board 124 to the high-voltage power supply board 124 through the harness 128, and outputs a control signal for controlling the high-voltage power supply board 125 to the high-voltage power supply board 125 through the harness 129.

As shown in FIG. 8, the low-voltage power supply harnesses 126, 127 are disposed along the top surface of the bottom frame 103 so as to extend between the first side-frame 101 (in the right side in FIG. 8) and the second side-frame 102 (in the left side in FIG. 8) in the lowest portion of the body of the laser printer 1.

The low-voltage power supply harnesses 126, 127 are protected by a protection cover 105 which covers the low-voltage power supply harnesses 126, 127 with the bottom frame 103 so as to sandwich the harnesses 126, 127 therebetween.

In the present embodiment, the protection cover 105 is made of resin or metal, and attached to the bottom frame 103 by an elastically deformable locking member or an attachable/detachable mechanical fixing member, such as a screw.

3. Feature of Laser Printer in Present Embodiment

In the present embodiment, the high-voltage power supply boards 124, 125 are disposed in the top side of the paper feed tray 21 and the low-voltage power supply harnesses 126, 127 are disposed in the bottom side of the paper feed tray 21. In other words, the paper feed tray 21 interposes between the low-voltage electric harnesses 126, 127 and the high-voltage power supply boards 124, 125.

Therefore, the low-voltage electric harnesses 126, 127 can be insulated from the high-voltage power supply boards 124, 125. As a result, the low-voltage power supply harnesses 126, 127 can be inhibited from being influenced by high voltage, as compared to a ease, for example, wherein the low-voltage power supply harnesses 128, 127 are disposed together with a high-voltage board, such as the high-voltage power supply board 124, in one side of the paper feed tray 21.

If the low-voltage power supply harnesses 126, 127 are disposed in the bottom side of the bottom frame 103, extra assembling processes are required for attaching the harnesses 126, 127 because the harnesses 126, 127 are disposed in the rear side of the bottom frame 103 and cannot be directly seen. The laser printer 1 needs to be reversed in the up-and-down direction in order to attach the low-voltage power supply harnesses 126, 127.

On the other hand, in the present embodiment, the low-voltage power source harnesses 126, 127 are disposed on the top side of the bottom frame 103, and can be directly seen through the installation opening 22.

Therefore, the laser printer 1 does not have to be reversed in the up-and-down direction in order to attach the harnesses 126, 127. As a result, the number of assembling processes and the manufacturing cost of the laser printer 1 can be reduced.

Moreover, since the low-voltage electric harnesses 126, 127 are disposed in the vicinity of the installation opening 22, assembling personnel can attach the harnesses 126, 127 to the bottom frame 103 from the installation opening 22.

As compared to a case wherein the low-voltage power supply harnesses 126, 127 are disposed in the rear side away from the installation opening 22, the harnesses 126, 127 can be more easily disposed. Therefore, the number of assembling processes of the laser printer 1 can be reduced.

In the present embodiment, the bottom frame 103 is disposed toward the installation opening 22 in the body of the laser printer 1. Thus, when the low-voltage power supply harnesses 126, 127 are disposed along the frame 100, the harnesses 126, 127 are consequently disposed in the vicinity of the installation opening 22. In case the bottom frame 103 is formed in a plate shape extending approximately in the entire area in the insertion direction, the harnesses 126, 127 should be preferably disposed in a portion of the plate-shaped bottom frame 103 in the vicinity of the installation opening 22.

In the present embodiment, due to the protection cover 105 being provided for covering the low-voltage power supply harnesses 126, the endurance period of the harnesses 126, 127 can be inhibited from being short 127, which otherwise may be caused by the paper feed tray 21 and the harnesses 126, 127 being in friction and being abraded.

Furthermore, in the present embodiment, the first and the second side-frames 101, 102 are formed approximately in a plate shape so as to extend in the vertical direction. The surfaces of the low-voltage power supply circuit substrate 123 and the high-voltage power supply board 125 are attached to the first side-frame 101 so as to be in parallel to the first side-frame 101. The surfaces of the drive unit control board 122 and the main control board 121 are attached to the second side-frame 102 so as to be approximately in parallel to the second side-frame 102. Therefore, as compared to a case wherein all the boards 121, 122, and 125 and substrate 123 are disposed so as to extend in the horizontal direction, the size of the laser printer 1 in the horizontal direction can be reduced.

Still furthermore, in the present embodiment, the duplex print unit 90 is disposed in the lowest portion of the body of the laser printer 1 so as to effectively use the dead space, created in the lowest portion of the laser printer 1, and the bottom frame 103, and to dispose the low-voltage power source harnesses 126, 127. Therefore, the low-voltage power source harnesses 126, 127 can be inhibited from being influenced by high voltage, such as from the high-voltage electric board 124 and the like, without making major changes in the structure of the laser printer 1.

Other Embodiment

In the above-described embodiment, the drive unit control board 122 is attached to the second side-frame 102 such that the drive unit 110 interposes therebetween. However, the present invention is not limited to the above structure. The drive unit control board 122 may be directly attached to the second side-frame 102.

Moreover, in the above-described embodiment, the high-voltage power supply boards 124, 125 are disposed above the paper feed tray 21 whereas the low-voltage power supply harnesses 126, 127 are disposed below the paper feed tray 21. The present invention is characterized in disposing the high-voltage power supply boards 124, 125 in one side of the paper feed tray 21, and the low-voltage power supply harnesses 126, 127 in another side. Therefore, the high-voltage power supply board may be, for example, disposed in the right side of the paper feed tray 21, and the low-voltage power supply harnesses 126, 127 may be disposed in the left side.

In addition, in the above-described embodiment, the low-voltage power source harnesses 126, 127 are disposed in the top side of the bottom frame 103. However, the present invention is not limited to the above structure. The low-voltage power supply harnesses 126, 127 may be disposed in the bottom side of the bottom frame 103.

Moreover, in the above-described embodiment, the protection cover 105 is provided. However, the present invention is not limited to the above structure. A groove, for example, may be provided to the bottom frame 103, instead of the protection cover 105, so as to lay the low-voltage power source harnesses 126, 127 in the groove.

Furthermore, in the above-described embodiment, the present invention is applied to the laser printer 1 including the duplex print unit 90. However, application of the present invention is not limited to the above application.

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

What is claimed is:

1. An image forming apparatus comprising:

a placement tray that holds a recording sheet thereon;

an image forming unit that forms an image on the recording sheet;

a drive unit that supplies driving force to the image forming unit;

a control board that controls the drive unit;

a power supply substrate that supplies electric power to the control board;

a high-voltage board, disposed on one side of the placement tray, in which voltage is generated higher than voltage in the power supply substrate; and low-voltage power supply harnesses disposed on another side of the placement tray so as to supply electric power from the power supply substrate to the control board, wherein the placement tray is interposed between the high-voltage board and the low-voltage power supply harnesses.

2. The image forming apparatus as set forth in claim 1 further comprising a frame including:

a first side-frame;

a second side-frame disposed so as to face the first side-frame in a horizontal direction; and a bottom frame disposed in a bottom portion of a body of the image forming apparatus so as to connect bottom portions of the first and the second side-frames, wherein the image forming unit, the high-voltage board and the placement tray are disposed between the first and the second side-frames, and wherein the low-voltage power supply harnesses are disposed below the placement tray in vicinity of the bottom frame and extend along the bottom frame.

3. The image forming apparatus as set forth in claim 2, wherein the placement tray is installed in the body of the image forming apparatus in an attachable/detachable manner, wherein the body of the image forming apparatus is provided with an installation opening through which the placement tray is installed, and wherein the low-voltage power supply harnesses are disposed below the placement tray in vicinity of a top surface of the bottom frame and extend along the top surface of the bottom frame.

4. The image forming apparatus as set forth in claim 3 wherein the low-voltage power supply harnesses are disposed on a portion of the bottom frame in vicinity of the installation opening.

5. The image forming apparatus as set forth in claim 2 further comprising a protection cover that covers the low-voltage power supply harnesses.

6. The image forming apparatus as set forth in claim 5 wherein the low-voltage power supply harnesses are sandwiched between the protection cover and the bottom frame.

7. The image forming apparatus as set forth in claim 2, wherein the first and the second side-frames are formed approximately in a plate shape so as to extend in a vertical direction, wherein the power supply substrate is attached to the first side-frame so as to extend approximately in parallel to the first side-frame, and wherein the control board is attached to the second side-frame so as to extend approximately in parallel to the second side-frame.

8. The image forming apparatus as set forth in claim 1 further comprising a frame including:

a first side-frame;

a second side-frame disposed so as to face the first side-frame in a horizontal direction; and a bottom frame disposed in a bottom portion of a body of the image forming apparatus so as to connect bottom portions of the first and the second side-frames, wherein the image forming unit, the high-voltage board and the placement tray are disposed between the first and the second side-frames, and wherein the low-voltage power supply harnesses are disposed on a bottom side of the placement tray between the placement tray and the bottom frame, and the control board is disposed on a top side of the placement tray.

9. The image forming apparatus as set forth in claim 8 further comprising a protection cover that covers the low-voltage power supply harnesses.

10. The image forming apparatus as set forth in claim 9 wherein the low-voltage power supply harnesses are sandwiched between the protection cover and the bottom frame.

11. The image forming apparatus as set forth in claim 8, wherein the first and the second side-frames are formed approximately in a plate shape so as to extend in a vertical direction, wherein the power supply substrate is attached to the first side-frame so as to extend approximately in parallel to the first side-frame, and wherein the control board is attached to the second side-frame so as to extend approximately in parallel to the second side-frame.

* * * * *